US010640970B2

(12) United States Patent
Sarda

(10) Patent No.: US 10,640,970 B2
(45) Date of Patent: May 5, 2020

(54) CONCRETE BUILDING ELEMENTS AND ASSEMBLIES THEREOF, AND RELATED METHODS

(71) Applicant: Nandy Sarda, Las Vegas, NV (US)

(72) Inventor: Nandy Sarda, Las Vegas, NV (US)

( * ) Notice: Subject to any disclaimer, the term of this patent is extended or adjusted under 35 U.S.C. 154(b) by 0 days.

(21) Appl. No.: 15/665,827

(22) Filed: Aug. 1, 2017

(65) Prior Publication Data

US 2019/0040620 A1 Feb. 7, 2019

(51) Int. Cl.

| | |
|---|---|
| ***E04B 1/21*** | (2006.01) |
| ***E04C 1/41*** | (2006.01) |
| ***E04B 1/22*** | (2006.01) |
| ***E04C 3/34*** | (2006.01) |
| ***E04B 1/16*** | (2006.01) |
| ***E04B 5/04*** | (2006.01) |
| ***E04B 5/17*** | (2006.01) |
| ***E04C 3/20*** | (2006.01) |
| ***E04C 3/293*** | (2006.01) |
| ***E04C 3/26*** | (2006.01) |

(52) U.S. Cl.

CPC ..... *E04B 1/215* (2013.01); *E04B 1/164* (2013.01); *E04B 1/22* (2013.01); *E04B 5/04* (2013.01); *E04B 5/043* (2013.01); *E04B 5/17* (2013.01); *E04C 1/41* (2013.01); *E04C 3/20* (2013.01); *E04C 3/293* (2013.01); *E04C 3/34* (2013.01); *E04B 2005/173* (2013.01); *E04B 2005/176* (2013.01); *E04C 3/26* (2013.01)

(58) Field of Classification Search

CPC ... E04B 1/215; E04B 1/22; E04C 3/34; E04C 3/26; E04C 1/41

See application file for complete search history.

(56) References Cited

U.S. PATENT DOCUMENTS

| | | | | | |
|---|---|---|---|---|---|
| 938,458 | A | * | 11/1909 | Brockhausen | E04B 5/43 256/19 |
| 1,031,047 | A | * | 7/1912 | Conzelman | E04B 1/21 52/259 |
| 1,060,853 | A | * | 5/1913 | Peirce | E04B 1/185 256/19 |
| 1,516,074 | A | * | 11/1924 | Borg | E04B 1/21 52/236.9 |

(Continued)

FOREIGN PATENT DOCUMENTS

| | | | |
|---|---|---|---|
| JP | 05106282 | A * | 4/1993 |
| JP | 05263533 | A * | 10/1993 |
| JP | 07247627 | | 9/1995 |

OTHER PUBLICATIONS

PCT International Searching Authority; International Search Report and Written Opinion dated Nov. 9, 2018; entire document.

*Primary Examiner* — Basil S Katcheves
*Assistant Examiner* — Omar F Hijaz
(74) *Attorney, Agent, or Firm* — Allen Dyer Doppelt & Gilchrist, PA

(57) ABSTRACT

An assembly of concrete structural elements includes a first and a second concrete lower column, and a first and a second column capitals are supported on respective upper ends of the respective first and second lower columns. At least one inverted beam is extended between the first and second column capitals. At least one lower flat surface of the inverted beam is positioned on respective edges of the first and second column capitals.

6 Claims, 7 Drawing Sheets

(56) References Cited

U.S. PATENT DOCUMENTS 2,033,595 A * 3/1936 Strehan ..... E04B 5/43 52/260
3,645,056 A * 2/1972 Gerola ..... E04B 1/043 52/259
3,708,933 A 1/1973 Yang
3,918,222 A * 11/1975 Bahramian ..... E04B 5/04 29/452
3,922,413 A * 11/1975 Reineman ..... E04C 2/2885 264/129
4,123,881 A * 11/1978 Muse ..... E04B 2/44 52/100
4,134,241 A * 1/1979 Walton ..... E04B 2/16 52/275
4,454,702 A * 6/1984 Bonilla-Lugo ..... E04B 2/847 52/251
4,856,248 A * 8/1989 Larson ..... E04C 1/41 52/100
4,945,695 A * 8/1990 Majurinen ..... E04B 1/16 52/220.3
4,986,049 A * 1/1991 Kennedy ..... E04C 1/41 52/309.12
5,398,470 A * 3/1995 Ritter ..... E04B 35/38 52/309.11
5,697,189 A * 12/1997 Miller ..... E04C 2/2885 52/309.12
5,704,174 A * 1/1998 Dal Lago ..... E04B 1/20 52/220.5
5,950,376 A * 9/1999 Kemeny ..... E04H 9/02 52/167.1
6,006,485 A * 12/1999 Hobbs ..... E04B 1/24
8,621,807 B2 * 1/2014 Charvoz ..... E04C 2/044 52/414
9,670,670 B2 * 6/2017 Teron ..... E04B 5/48
9,765,521 B1 * 9/2017 Abbas ..... E04C 3/26
2004/0231256 A1 * 11/2004 Ohnishi ..... E04B 1/3483 52/236.7
2007/0283645 A1 * 12/2007 Ryan ..... E02D 27/42 52/294
2008/0060293 A1 * 3/2008 Hanlon ..... E04B 1/20 52/251
2009/0151298 A1 * 6/2009 Jazzar ..... E04B 1/164 52/745.05
2012/0047816 A1 * 3/2012 Zhong ..... E04B 1/161 52/11
2012/0233936 A1 9/2012 Zhong
2013/0074430 A1 * 3/2013 Morcous ..... E04B 5/16 52/252
2013/0168041 A1 * 7/2013 Teron ..... E04B 5/48 165/49
2017/0159294 A1 * 6/2017 Sanabra Loewe ..... E04C 3/34

* cited by examiner

CONCRETE BUILDING ELEMENTS AND ASSEMBLIES THEREOF, AND RELATED METHODS

FIELD OF THE INVENTION

The present invention relates to concrete building elements, and more particularly, to concrete beams and assemblies and related methods of assembly.

BACKGROUND

In structural engineering, the use of assembled concrete structural elements of buildings is well known. A plurality of columns, column capital panels, beams, and slabs are often combined in a unified assembly according to a construction design. Many varieties of construction technique employ vertically disposed columns to support load-bearing beams interconnecting adjacent columns. The load-bearing beams can thus provide support for one or more floors above constructed of precast or poured-in-place floor slabs, or a combination of the two. A load in a concrete structure is carried by both its concrete structural elements and reinforcement within and between these elements. Common concerns of a concrete element assembly are structural strength, appearance, versatility and the practical difficulty of connecting one structural element to another. Some advancements have been made on the noted aspects of concrete elements for building construction. However, more improvements are possible.

SUMMARY OF THE INVENTION

In view of the foregoing, it is an object of the present invention to provide improved concrete building elements, assemblies thereof and related methods.

According to an embodiment of the present invention, an assembly of concrete structural elements includes a first and second concrete lower columns and a first and second column capitals supported on the respective upper ends of the lower columns. At least one inverted beam is extended between the first and second column capitals. At least one lower flat surface of the inverted beam is positioned on the respective edges of the first and second column capitals.

According to another embodiment of the present invention, an inverted beam element configured for positioning between a first and second column capitals includes an upper flat surface, at least one downward projecting leg, and at least one flat lower surface at the bottom of the at least one downward projecting leg. At least one flat lower surface is configured for positioning on the respective edges of the first and the second column capitals. The flat upper surface of the inverted beam element includes hook bars to facilitate a connection with an adjacent structural element.

According to a method of the present invention, assembling a plurality of concrete structural elements includes arranging an inverted beam (e.g., Inverted L-beam or Inverted U-beam) between respective edges of a first column capital and a second column capital. A rigid panel is attached to a side surface of at least one leg of the inverted beam. Concrete is poured into an interior volume of the first and second column capital. The one or more rigid panels are removed after the concrete is cured.

These and other objects, aspects and advantages of the present invention will be better appreciated in view of the drawings and following detailed description of preferred embodiments.

DETAILED DESCRIPTION OF PREFERRED EMBODIMENTS

Figure 1:
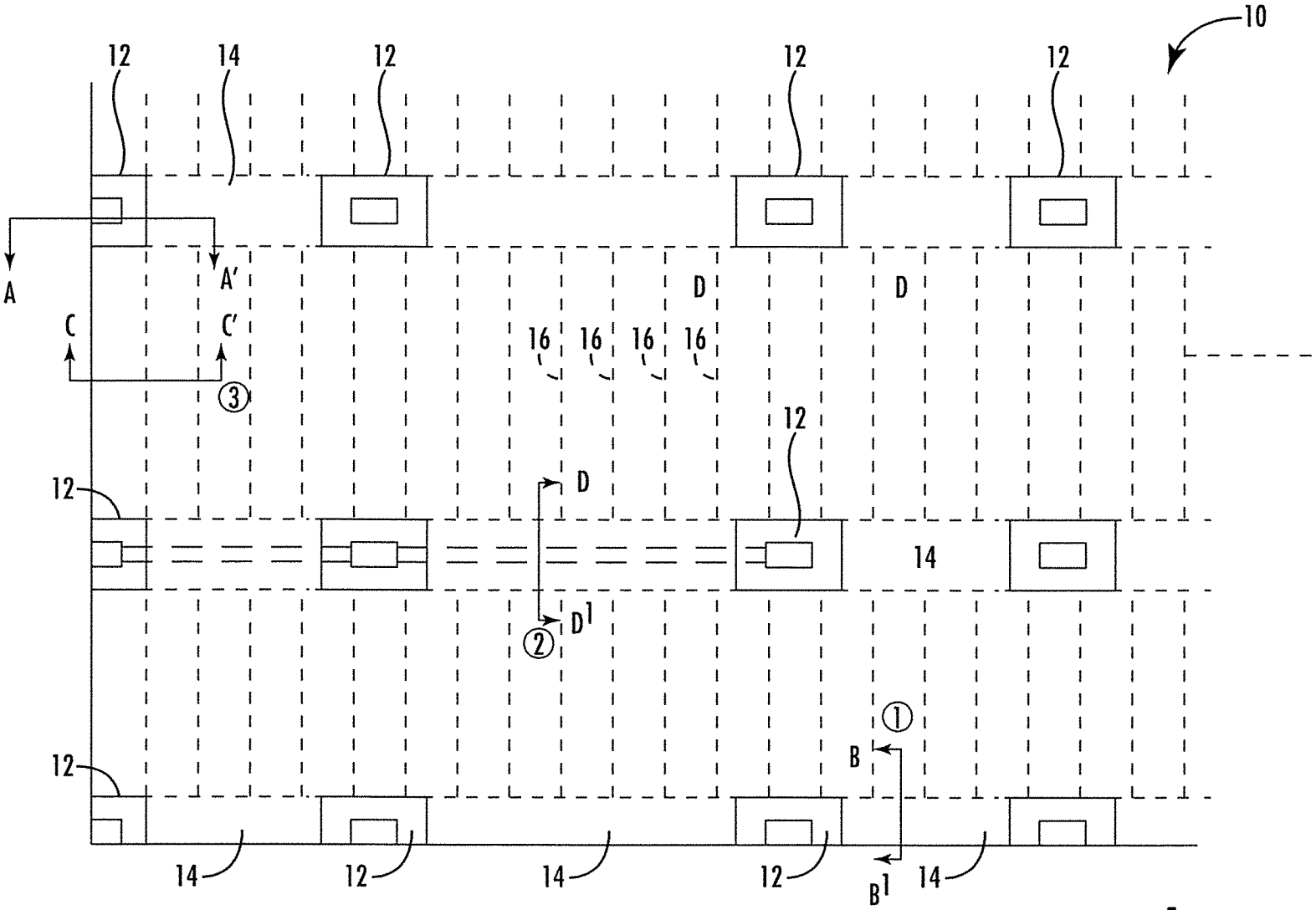
FIG. 1 is a top plan view of a concrete construction site, according to one embodiment of the present invention.

According to an embodiment of the present invention, referring to FIG. 1, a concrete construction site 10 include a plurality of concrete column assemblies 12 and respective supporting beams 14 connected between the concrete column assemblies 12. A plurality of slabs 16 extend in parallel rows between respective concrete column assemblies 12 and supporting beams 14. For clarity of illustration, the concrete columns, column capitals, supporting beams and associated reinforcement extending therethrough are not shown in detail in FIG. 1.

With reference to FIGS. 2-8, the assembly of the structural elements and further features thereof will be described. These structural elements are selected for exemplary and illustrative purposes only; it will be appreciated that the present invention is not necessarily limited thereto.

Figure 2:
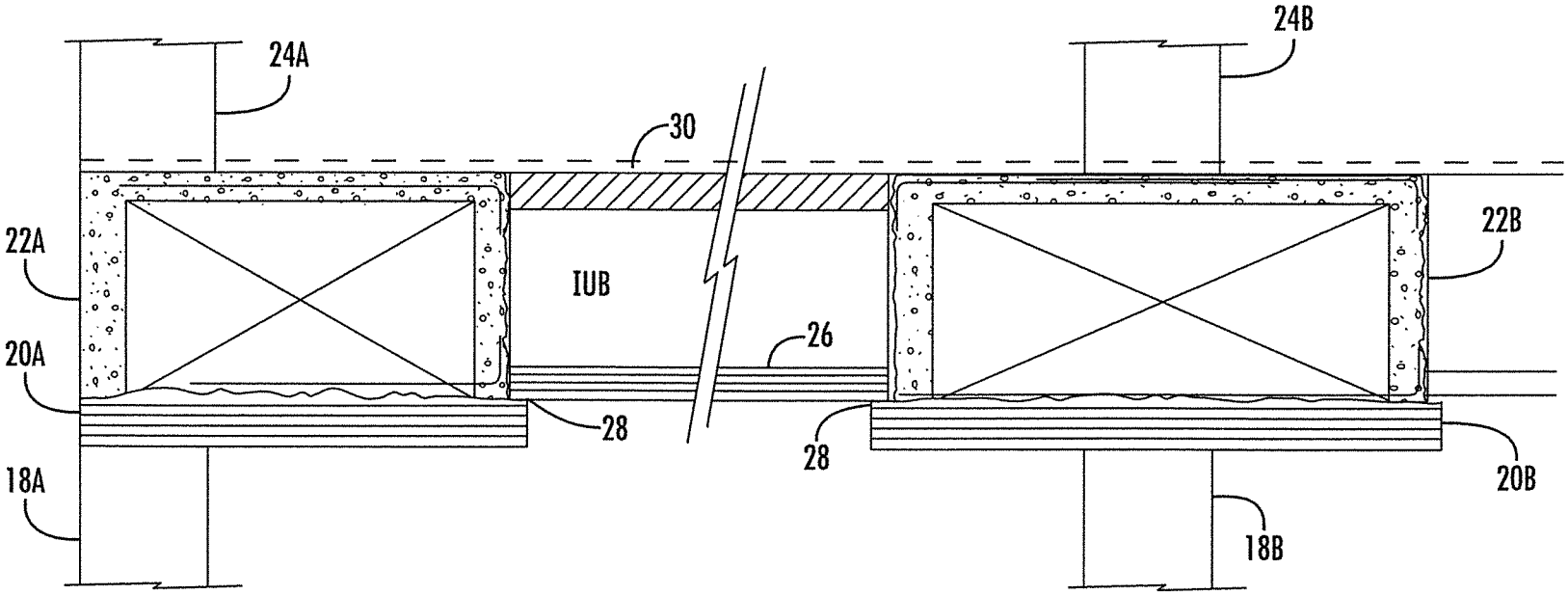
FIG. 2 is a side elevational view of two supporting columns and an inverted beam therebetween of FIG. 1 along lines A-A'.

Referring to FIG. 2, a side view of a section of the construction site 10 precast concrete column 12 includes two concrete lower columns 18A and 18B, column capitals 20A and 20B supported on an upper end of the respective lower columns 18A and 18B, and support blocks 22A and 22B positioned on an upper end of the respective column capitals 18A and 18B and surrounding the respective higher columns 24A and 24B on the upper end of the respective lower column 18A and 18B. An inverted beam 26 is positioned between edges of the first and second column capitals 20A and 20B. A poured footing (not shown) can be configured to support respective lower ends of the lower columns 18A and 18B.

The support blocks 20 can be solid concrete block or block with a concrete exterior portion and a polystyrene interior portion, as shown. The support block 20 is dimensioned to be smaller than the footprint of the column capital 18 such that respective lips 28 are formed on the edge of the upper surface of the column capitals 20A and 20B. In the depicted embodiment, an upper surface of the inverted beam 26 is level with the upper surface of the column capital 18.

An optional layer of concrete topping 30 can be placed on the respective supporting blocks 22A and 22B and the inverted beam 26.

Figure 3:
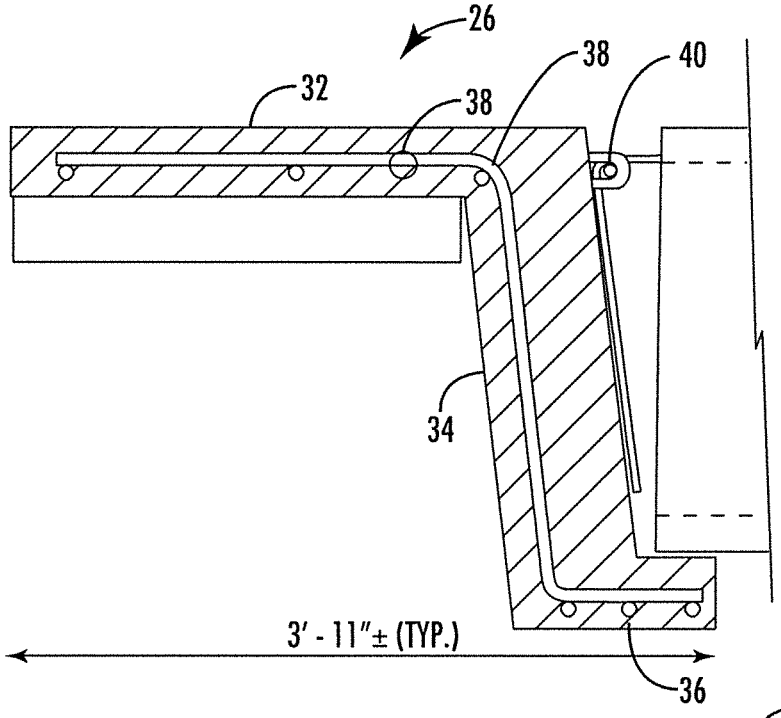
FIG. 3 is a cross sectional view of an inverted beam between two supporting columns of FIG. 1 along lines B-B', according to one embodiment of the present invention.

Referring to FIG. 3, according to one embodiment of the present invention, an inverted beam 26 is an inverted L-beam (ILB) as shown. The figure shows a cross sectional view along the line B-B' in FIG. 1. The ILB has a flat upper surface 32, a downward projecting leg 34, and a flat lower surface 36 extending from a lower end of the projecting leg 34. Referring now to FIG. 2, the flat lower surface 36 is configured to be positioned on the respective lips 28 of the capital columns 20A and 20B. This configuration of the ILB 26 is the most suitable one for a peripheral wall made of concrete. The ILB 26 is preferably made of pre-stressed concrete with pre-stressed cables 38 embedded therein. The pre-stressed cables 38 can include a single-wire strand, a multi-wire strands or threaded bars, and the like. The pre-stressed cables 38 can be made from high tensile steels, carbon fiber, aramid fibers and the like. The pre-stressed cables 38 serve as a means of creating an artificial load that opposes the ILB's service loads and offsets part of them. The ILB 26 can have a width that corresponds to the width of the column capital it rests on.

Figure 4:
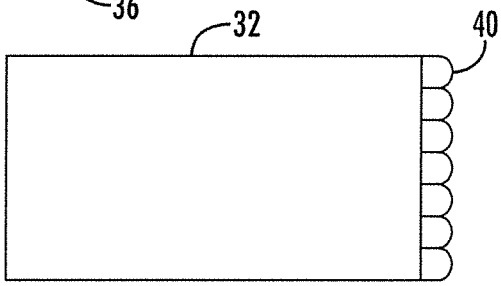
FIG. 4 is a top plan view of the inverted beam of FIG. 3.

Referring to FIG. 4, a plurality of hook bars 40 extend from one or more ends of the top surface 32 of an ILB 26. The hook bars 40 are preferably made of steel or similarly strong and rigid material and are partially embedded into the one or more ends of the ILB 26. The hook bars 40 can be used to tie a hollow core plank or other adjacent structural elements to form a rigid mechanical connection.

Figure 5:
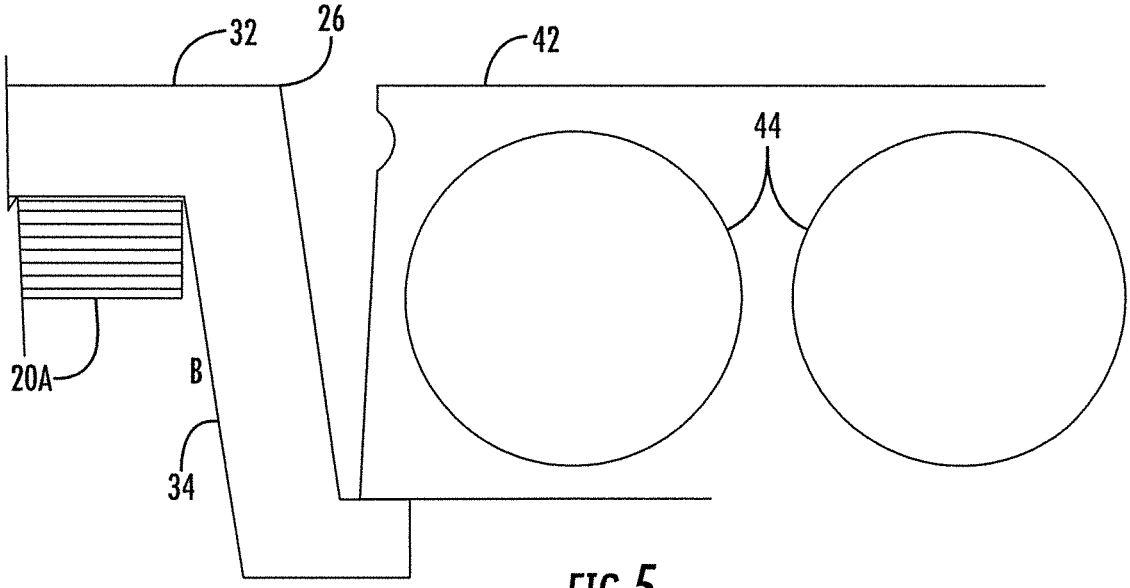
FIG. 5 is a cross sectional view of an inverted beam between two supporting columns of FIG. 1 along lines C-C', according to another embodiment of the present invention.

Referring to FIG. 5, the plurality of hook bars 40 are tied to a hollow core plank 42. In the depicted embodiment, the hollow core plank 42 has a plurality of tubular voids 44 for receiving respective slabs (not shown), typically with a diameter of ⅔-¾ inches. The slabs received inside the voids 44 can be precast hollow core slabs or any suitable precast or cast-in-place slabs.

Figure 6:
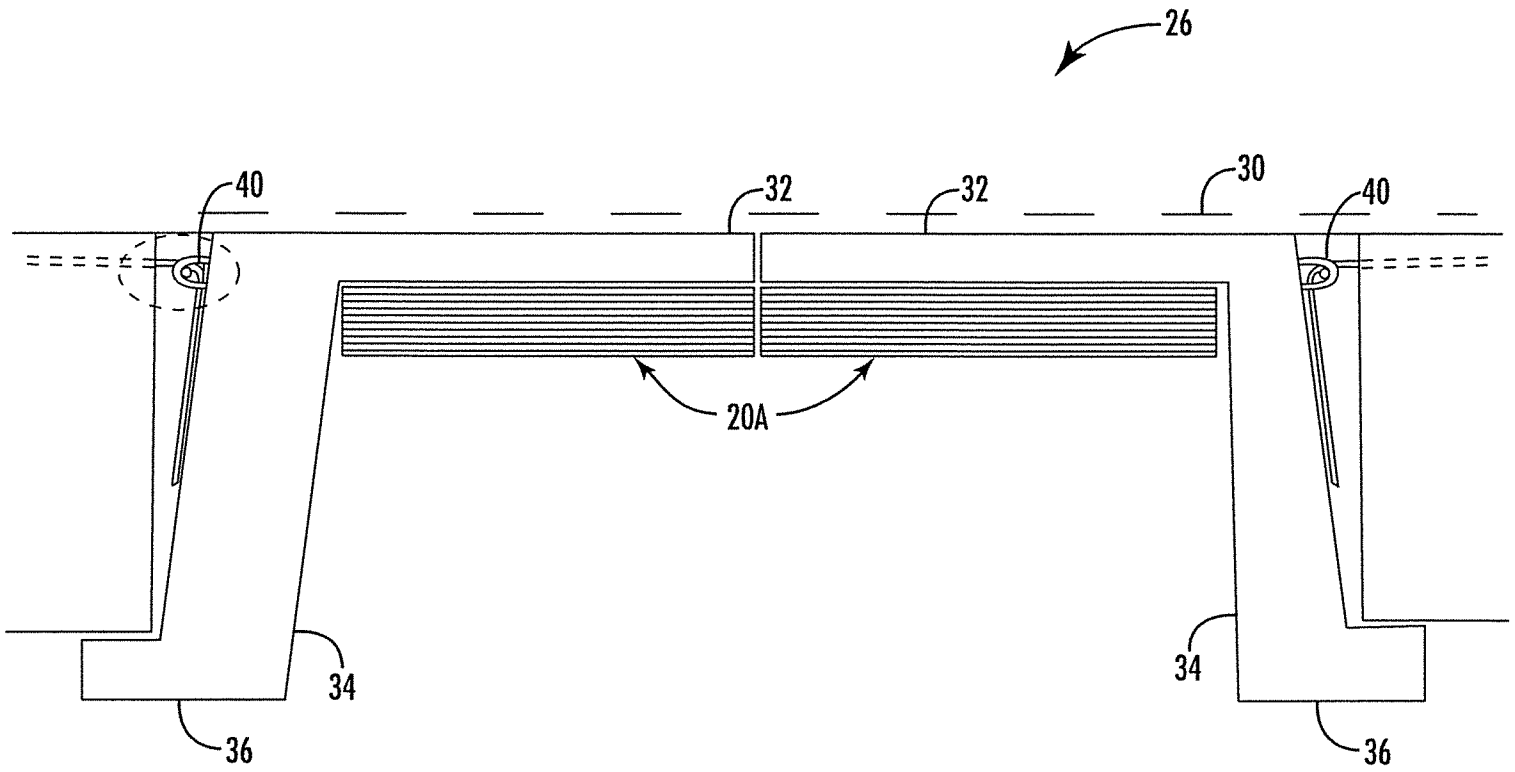
FIG. 6 is a cross sectional view of an inverted beam between two supporting columns of FIG. 1 along lines D-D', according to one embodiment of the present invention.
Figure 7:
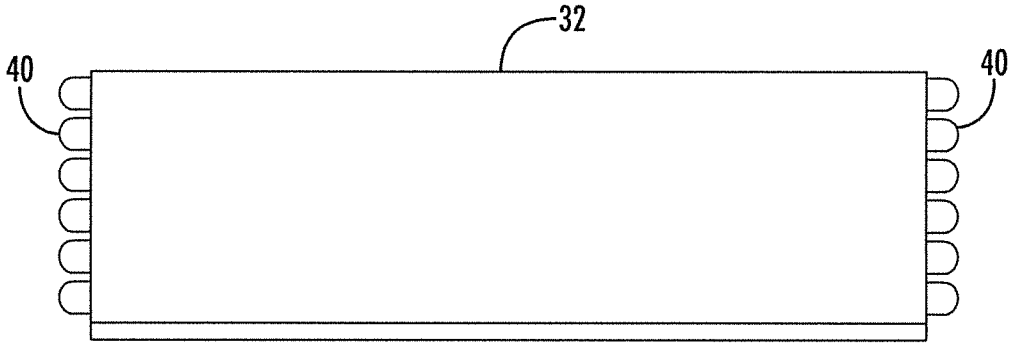
FIG. 7 is a top plan view of the inverted beam of FIG. 6.

Referring to FIG. 6, according to an alternative embodiment of the present invention, an inverted beam 26 can be an inverted U-beam (IUB) essentially made of two opposed ILBs of FIG. 3. The depicted embodiment shows a cross-sectional view of the ILB 26 along the line D-D' of system 10. The IUB has a flat upper surface 32, two downward projecting legs 34 and two respective lower flat surfaces 36. The IUB is often used at the inner wall of a precast concrete system 10. As for the ILB depicted in FIG. 3, both ends of the top surface of the IUB can be attached to a plurality of hook bars. Referring to FIG. 7, a plurality of hook bars 40 extend from both ends of the top surface 32 of an ILB 26 of FIG. 6.

Figure 8:
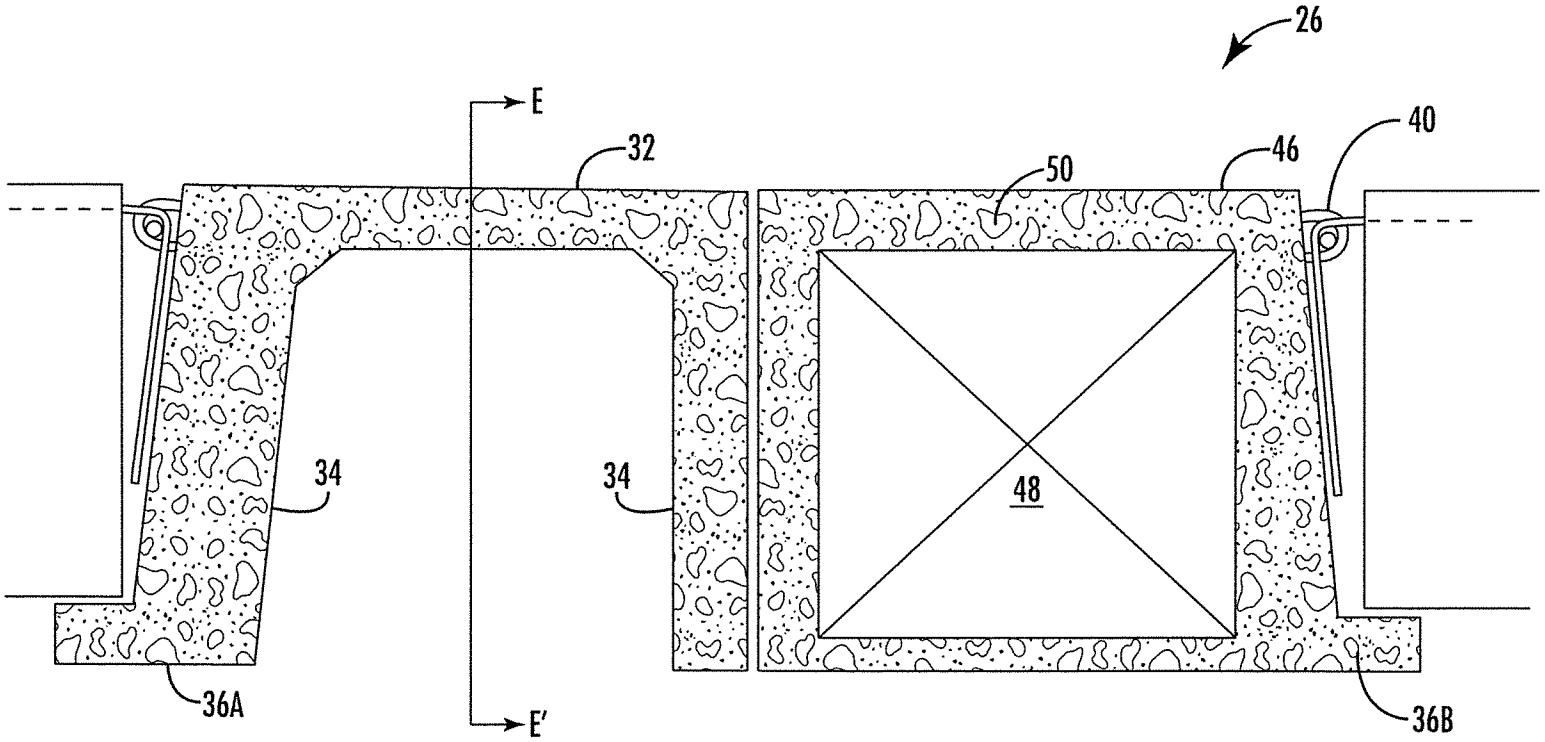
FIG. 8 is a cross sectional view of an inverted beam between two supporting columns of FIG. 1 along lines D-D', according to another embodiment of the present invention.

Referring to FIG. 8, according to an alternative embodiment of the present invention, an IUB includes include a U-shaped portion having a top surface 32, two downward projecting legs 34, and a rectangular block 46 attached a second leg of the IUB. A first lower flat surface 36A extends from the first leg 34, and a second lower surface 36B extends horizontally from a bottom portion of the rectangular block 46. To reduce the weight of the IUB, the block 46 can include an interior portion 48 filled with polystyrene material and an exterior concrete portion 50. This configuration will enable a forklift to maneuver the IUB more firmly by holding the block 46 of the IUB. The block 46 portion can also prevent concrete poured into the adjacent elements of the IUB (e.g., column capitals) to leak into the open space of the IUB and or between the IUB and adjacent structures. Similar to the ILB depicted in FIG. 3, both ends of the top surface 32 of the IUB 26 can be attached to a plurality of hooks 40 via rebars or other suitable connection methods. Other dimensions, shapes, configuration of the IUB 26 can also be used.

Figure 9:
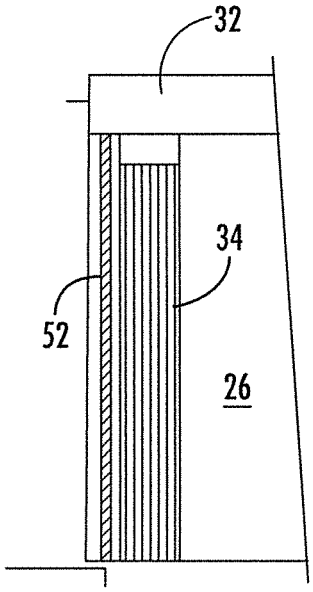
FIG. 9 is a cross sectional view of the inverted beam of inverted beam of FIG. 8 along lines E-E'.

FIG. 9 shows a cross sectional view along lines E-E' of the IUB 26 depicted in FIG. 8. In the depicted embodiment, one or more polystyrene panels or other rigid panels 52 are attached (e.g., glued) to the respective side surfaces of the IUB or ILB leg 34 before concrete is poured to the interior volume of the adjacent structural elements (e.g., first and second column capitals) of the IUB or ILB 26. The one or more rigid panels 52 can prevent concrete from leaking into the volume between the inverted beam 26 and adjacent structural elements. After concrete is poured and cured, the one or more polystyrene panels 52 can be removed.

Figure 10:
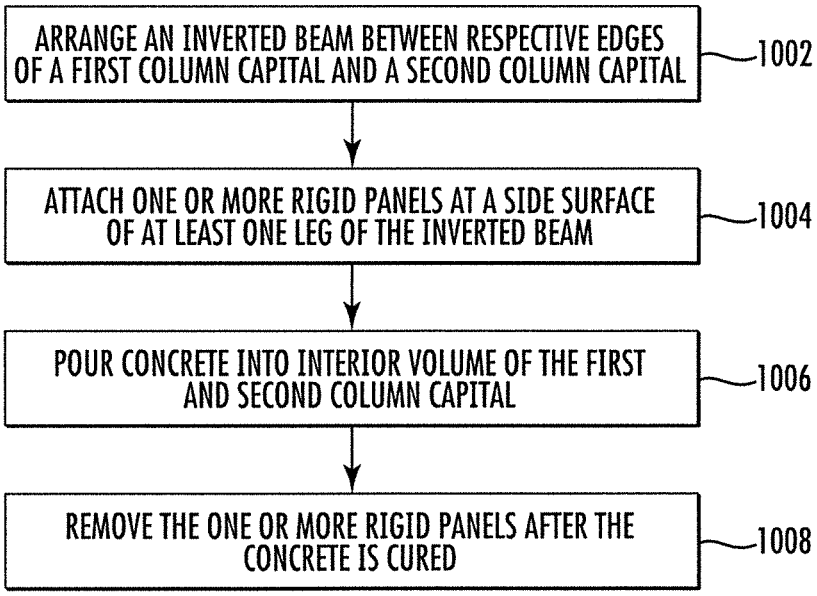
FIG. 10 is a flow chart illustration of a method for assembling a plurality of concrete structural elements.

Referring to FIG. 10, a method for assembling a plurality of concrete structural elements includes arranging an inverted beam between respective edges of a first column capital and a second column capital at step 1002. At step 1004, a rigid panel is attached at a side surfaces of a leg of the inverted beam 26. At step 1006, concrete is poured into interior volume of the first and second column capital. At step 1008, the rigid panel is removed after the concrete is cured.

The dimension of the inverted beam 26 can readily be adjusted to achieve a close match to the dimension of column capitals or other suitable elements. This will simplify tying together structural elements and increase its effectiveness, ensuring accurate final alignment and placement of the inverted beams and nearby structures. The present invention can significantly increase the stability and strength of the concrete structure system. As a result, energy dissipation capacity will be increased significantly over structural elements lacking inverted beams.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and the claims appended hereto.

What is claimed is:

1. An assembly of concrete structural elements comprising:

a first and a second concrete lower column having a first and a second upper column end, respectively;

a first column capital supported on the first upper column end and a second column capital supported on the second upper column end, the first and the second column capital having a first and a second capital upper surface, respectively;

an inverted beam extending from a first beam end supported on the first capital upper surface to a second beam end supported on the second capital upper surface, the inverted beam including a flat upper beam surface, a first downward projecting leg extending between the first and second beam ends, and a first flat lower projecting leg surface extending outwardly from the first downward projecting leg below the flat upper beam surface between the first and second beam ends, the flat upper beam surface and lower projecting leg surface being separated vertically by a projecting leg height, the inverted beam being elongated in a first direction between the first and second beam ends; and a plank having a first plank end supported on the first flat lower projecting leg surface, the plank having a plank height equal to the projecting leg height such that a flat upper plank surface is level with the flat upper beam surface, the first plank end extending vertically downward from the flat upper plank surface, the first plank being elongated away from the first plank end in a second direction perpendicular to the first direction;

wherein the first downward projecting leg angles away from the first flat lower leg projecting leg surface and the first plank end such that a horizontal gap exists between the flat upper beam surface and the flat upper plank surface at the first plank end; and wherein a plurality of hook bars extending from the first downward projecting leg adjacent the flat upper beam surface rigidly tie the plank to the beam in an area below the horizontal gap and above the first flat lower projecting leg surface.

2. The assembly of claim 1, wherein the inverted beam further includes a second downward projecting leg extending between the first and second beam ends, and a second flat lower projecting leg surface extending outwardly from the second downward projecting leg below the flat upper beam surface between the first and second beam ends.

3. The assembly of claim 1, further comprising a rectangular block attached to the first downward projecting leg, and an upper surface of the rectangular block is level with the flat upper beam surface, and the first flat lower projecting leg surface extending outwardly from the rectangular block below the upper surface of the rectangular block between the first and second beam ends.

4. The assembly of claim 3, wherein the rectangular block includes a polystyrene foam interior portion and a concrete exterior portion.

5. The assembly of claim 1, wherein the inverted beam includes one or more pre-stressed cables embedded therein.

6. The assembly of claim 1, wherein the leveled upper beam surface and the upper plank surface are covered with a layer of concrete.

* * * * *